United States Patent [19]

Collins et al.

[11] Patent Number: 4,490,778

[45] Date of Patent: Dec. 25, 1984

[54] LUMINAIRE GLOBE ASSEMBLY

[75] Inventors: Byron R. Collins; William K. Dryman, both of Hendersonville, N.C.

[73] Assignee: General Electric Company, Schenectady, N.Y.

[21] Appl. No.: 564,118

[22] Filed: Dec. 21, 1983

[51] Int. Cl.[3] ..... F21V 29/00

[52] U.S. Cl. ..... 362/267; 362/306; 362/311; 362/355; 362/361; 362/363; 362/375

[58] Field of Search ..... 362/267, 311, 306, 355, 362/361, 363, 375

[56] References Cited

U.S. PATENT DOCUMENTS 3,675,007 7/1972 Appleton et al. ..... 362/363

*Primary Examiner*—Stephen J. Lechert, Jr.

*Attorney, Agent, or Firm*—Ernest W. Legree; Philip L. Schlamp; Fred Jacob

[57] ABSTRACT

A nonflame-propagating joint between the flared rim of a tempered glass globe and a globe support ring is effected by means of a gasket of a suitable moldable material, preferably solder, cast between the faying surfaces. The gasket may be cast in place by pouring molten solder between the globe and the preheated globe ring. Alternately a precast gasket may be assembled in placed between globe and globe ring, and recast by induction heating of the assembly.

9 Claims, 4 Drawing Figures

6
5
1
2
3
4

Fig. 2a
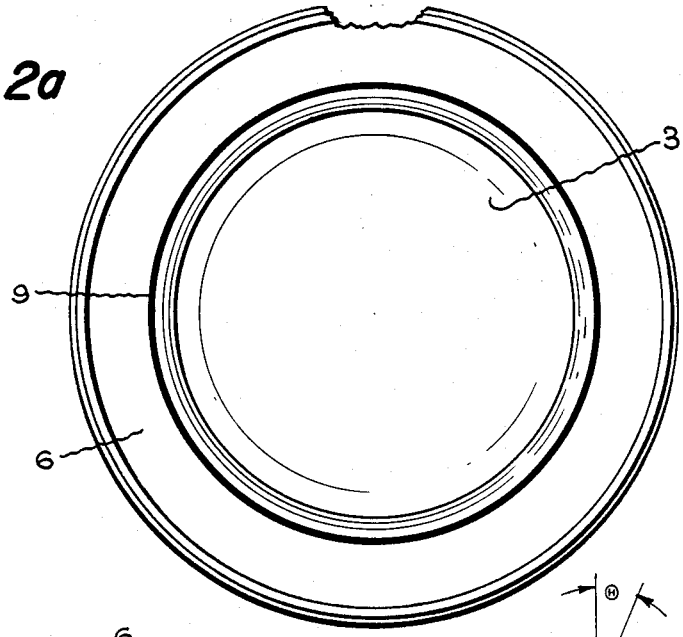
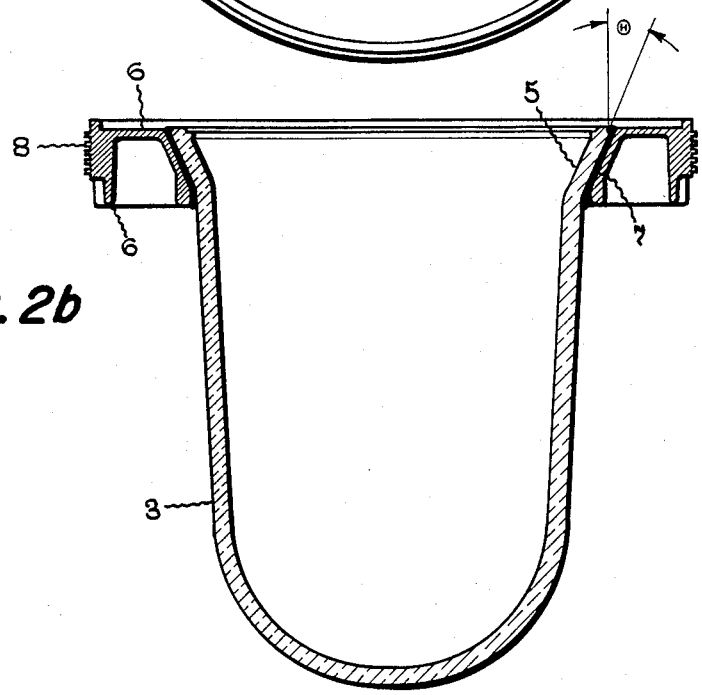
Fig. 2b

LUMINAIRE GLOBE ASSEMBLY

The invention relates to an assembly of a tempered glass globe with a globe ring forming a nonflame-propagating joint for use in a hazardous location lighting fixture or luminaire.

BACKGROUND OF THE INVENTION

A luminaire or lighting fixture is a mechanical assembly of parts which must be capable of disassembly for lamp replacement, and in practice it is impossible to have it perfectly hermetically sealed. Therefore, it is accepted that even with hazardous location luminaires, any ambient gas will in time find its way into the luminaire. Lighting fixtures listed by Underwriters Laboratories (UL) as suitable for use in hazardous locations in which combustible gases or vapors are present (Class 1, Division 1), are required to have enclosures for the electrical components having sufficient strength to withstand the explosion pressure should there be an electrical or other malfunction that ignites the gases inside. Furthermore, as the momentary pressure from the explosion inside relieves itself to the outside, the ignited gases must be cooled sufficiently as they exit that explosive gases on the outside are not ignited, such quality being commonly referred to as nonflame propagation through the joints.

The light source proper within the luminaire may be either a filament or an inner arc tube in the case of a high intensity discharge (HID) lamp. In either case the lamp envelope operates at a very high temperature and usually is merely thin (1 mm thick) and relatively fragile glass. Accordingly, a globe is needed to surround and shield the lamp envelope from damage while permitting the light to pass out, and to keep ignitable gases away from the high temperature surface of the lamp envelope itself.

The globe is made of pressed glass generally at least ¼ inch thick which has been tempered. In tempering, the glass globe is heated to a temperature adequate to relax internal stresses but permitting handling without deformation. The glass is then rapidly quenched by extracting heat from both surfaces at rates generating a symmetrical temperature profile across its thickness until the hottest point on the profile is below the effective solidification temperature. The result is a generally parabolic stress distribution across the thickness of the glass with compression at the surface balanced by tension in the interior.

Glass fractures when its tensile strength is exceeded and it is the outer surface that is vulnerable. With tempered glass, an external force such as a blow that would put an outer surface in tension must first neutralize the compressive prestress before any net tensile stress can develop at the surface, and thus breaking strength is enhanced. When tempered glass is broken, the strain energy reduces the glass into harmless small fragments more or less cubic in shape.

In globes for hazardous area luminaires as made up to the present, a thickened rim was provided which was generally at least twice as thick as the globe wall. The top of the rim was ground flat and engaged by the flat machined underside of a clamp ring to make a nonflame-propagating joint. The rim thickness was necessary in order to have a length of path across it sufficient for adequate cooling of exiting ignited gases, that is in order to avoid propagation of flame through the joint, as required by UL specifications. However the thick rim has been found to be a region in which over-tempering tends to occur and a source of inherent weakness, as disclosed in copending application Ser. No. 564,117, filed of even date herewith by Marcus P. Hogue, entitled Tempered Glass Globe, and assigned to the same assignee as the present invention. The Hogue invention eliminates the thickened rim and provides a tempered glass globe of substantially constant wall thickness throughout. This makes possible a more uniform cooling rate during the tempering quench cycle whereby overtempering and excessive tensile stresses within the glass are avoided.

With the Hogue constant wall thickness globe, the rim at the top of the globe is no different in wall thickness and is outwardly flared at an angle between 15° and 45°. The globe is supported by nesting the section of cone formed by the flared rim in a mating conically apertured portion formed in a globe support ring. The globe is held down snugly in the globe ring by clamping means such as bolts and washers or spring clips provided around the periphery of the ring and engaging the top of the rim.

For a hazardous location lighting fixture, Underwriters Laboratories specification 844 defines the standard under which a joint must be qualified by test in order to be deemed nonflame propagating. It specifies the minimum length of the joint and the maximum clearance between surfaces at the joint, that is the maximum gap. The requirement in respect of joint or gap dimensions is related to the internal volume of the fixture and is expressed as a linear relationship between gap clearance amd length of gap. For examle, if the length of the joint is 1.125", a gap of 0.004" is acceptable; but if the joint is only 0.625" long, then the gap is limited to 0.0015". These constraints must be observed between the flared rim of the Hogue globe and the mating conically apertured portion of the support ring. But it is not yet technically feasible to press and temper a glass globe so that the rim is exactly true. It has been necessary to resort to grinding the flared glass rim in order to bring it within the specification requirements. Such grinding is expensive and, depending upon the extent needed, may amount to a substantial fraction of the cost of pressing and tempering the glass. Also grinding inevitably reduces the strength of the globe.

SUMMARY OF THE INVENTION

The object of the invention is to provide an improved nonflame-propagating joint between the flared rim of a tempered globe and the cone of a globe support ring suitable for use in a hazardous location luminaire. Among the desiderata sought in such joint are to reduce manufacturing cost and to avoid weakening the globe.

In accordance with our invention we achieve a nonflame-propagating joint between the flared rim of the globe and the conical aperture in the globe support ring by means of a gasket of a suitable material which is cast against the one particular globe with which it will be used. It may be cast between the one particular globe and one particular globe support ring, or alternatively it may be cast between the one particular globe and a machined mold corresponding dimensionally within suitable tolerances to the metal cone of the globe support ring. Either way any need for grinding the glass is eliminated. Suitable materials are moldable materials, that is materials which can be cast or molded, and which will withstand temperature cycling and hydrocarbon fumes at the operating temperature of the globe over extended periods of time. The preferred materials are low melting temperature metals or alloys such as solder.

In one assembly embodying the invention, solder is used for the metal gasket and the seal is made by pouring molten solder between the flared rim of the glass globe and the globe ring. The globe ring is preheated to a temperature near the melting temperature of the solder, and the lower opening of the joint is temporarily sealed before pouring to prevent the liquid solder from falling through.

In a preferred construction, an undercut groove or channel is machined in the globe ring near the top of the cone portion. The groove facilitates pouring the solder, and together both grooves filled with solder serve as keyways which tightly lock the globe to the globe ring. This eliminates any need for locking screws or clips to retain the globe against the globe support ring when the luminaire is inverted.

DESCRIPTION OF DRAWINGS

In the drawings:

FIGS. 2*a* and 2*b* are a top plan view and a vertical cross-section view of a joined flared rim globe and globe ring assembly embodying the invention.

DETAILED DESCRIPTION

Figure 1:
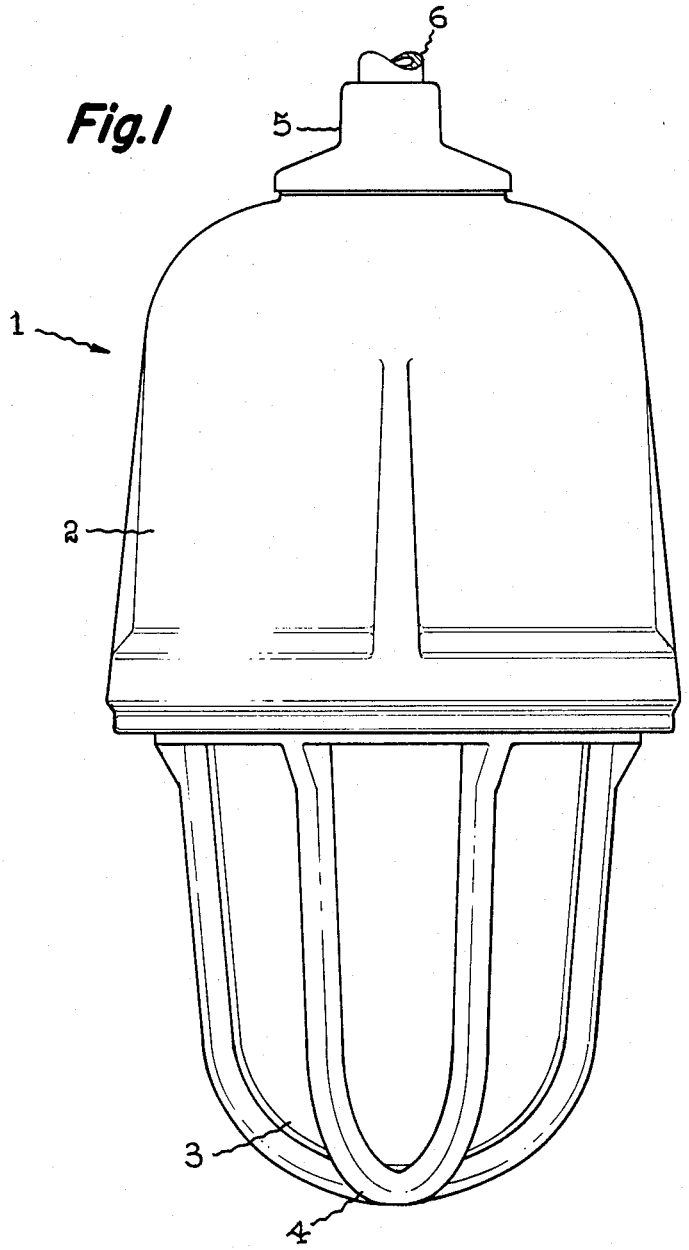
FIG. 1 illustrates a typical hazardous area luminaire utilizing a tempered glass globe.

Referring to FIG. 1, there is shown a hazardous duty type luminaire or lighting fixture 1 comprising a bell-like metal housing 2 and a glass globe 3 which forms a light-transmitting bottom closure. In a luminaire operating a gaseous discharge lamp such as a high pressure sodium vapor lamp, the housing 2 would contain the electrical ballast components such as a core and coil assembly, a pulse starter if used, and a capacitor if used, together with a screw socket for the lamp. The socket is mounted so that the lamp (not shown) hangs down within the globe. A cage-like protective guard 4 is secured along the bottom edge of the housing and extends around the globe 3. The luminaire is supported from the top, for instance by a hub 5 as shown which has standard pipe threads for accommodating the threaded end of a conduit 6, suitably ¾" or 1" steel pipe.

Figure 3:
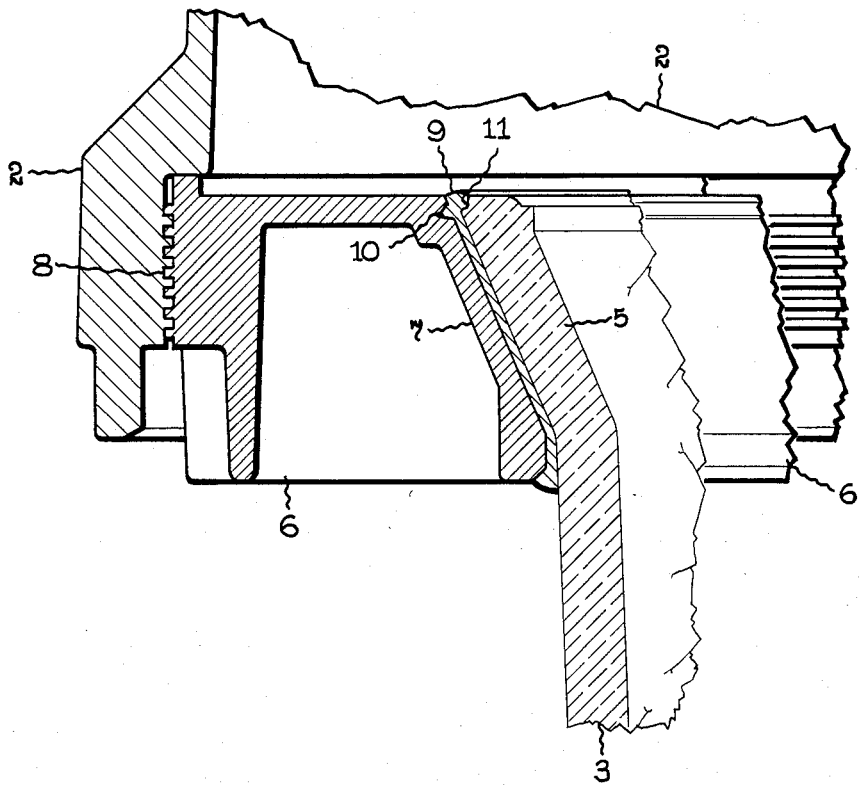
FIG. 3 is a cut-out section of the luminaire showing the joint to a larger scale.

As shown in FIGS. 2*a* and 2*b*, the walls of tempered glass globe 3 are substantially uniform in thickness throughout. For a typical hazardous location luminaire, a globe of soda lime glass having a wall thickness of about ⅜ inch is suitable. Such a globe pressed to the shape illustrated in FIG. 2*b* and having an overall length of about 10 inches weight about 6 pounds. The rim 5 is outwardly flared with a taper angle in the range of 15° to 45° as taught in the previously mentioned Hogue application, for instance 24°. The globe is fastened to the luminaire housing 2 shown in FIG. 3, and is supported by means of a globe ring 6 having a conically apertured portion 7 of predetermined slant length in which the flared rim 5 nests. The globe ring is usually made of aluminum and attaches to the luminaire housing 2 through Acme threads 8 which engage cooperating threads on the inside of the housing as shown in FIG. 3.

In the Hogue application, observance of the UL 844 constraints to assure a nonflame-propagating joint between the faying surfaces of cone 7 and flare 5 required grinding of the glass flare and accurate machining of the metal cone. Grinding of glass in particular is laborious and expensive. Our invention does away with the need for grinding the glass and can also make accurate machining of the metal cone unnecessary. We have found a simple solution to the problem which, reduced to its essentials, consists in casting a gasket of a suitable material such as solder between the globe and the globe ring. Since the solidified gasket fills completely the space between the faying surfaces there is no longer a need for accuracy in forming the surfaces.

Solder Pour Method

There are various ways of achieving the invention's ultimate objective giving rise to a variety of methods. One may assemble the globe and globe ring as shown in FIGS. 2*a* and 2*b* and pour low melting temperature metal or alloy into the joint. If solder is to be used for the metal, it should be preheated above its melting point, say above 360° F. for a eutectic alloy. The globe ring is preheated near the same temperature and the glass globe may be left at room temperature or heated. The joint is temporarily sealed at its lower opening by a high temperature resisting material such as a silicone rubber gasket to prevent the liquid solder from falling through the opening when it is poured into the joint. After the solder 9 has solidified the silicone gasket is removed and may be reused.

It is desirable to have the globe fastened to the globe ring so that it will be retained in place should the luminaire be inverted. In the Hogue application, this was accomplished by locking screws or clips. According to a feature of our invention, the joint is so shaped that the solder will lock the globe and globe ring together. This is accomplished by machining a groove with an undercut in the cone portion near the top of the globe ring, as shown at 10 in FIG. 4. The groove serves as a keyway by which the globe is tightly locked to the globe ring after the solder has solidified. The rim of the globe may be notched or beveled as shown at 11 to assure interlocking by the circumferential solder keyway and also to facilitate pouring of the solder.

Recast Gasket Method

Instead of pouring solder into the joint to make the metal gasket, an alternative is use a solder gasket previously die cast to fit approximately between globe ring and globe. The globe, solder gasket and globe ring are then assembled and the solder is melted by induction heating while the parts are pressed together. The precast gasket is thus effectively recast. It will be apparent that this method by avoiding the pouring of molten solder requires less skillful labor. However a disadvantage to the recast solder gasket method is the long heat up and cool down cycle due to the large thermal mass of the globe ring which is usually made of aluminum. Also the method consumes a relatively large amount of energy.

The cycle time and energy consumption of the recast gasket method may be reduced by substituting an accurately made ceramic mold or a thin-walled accurately-machined metal mold for the globe ring. After cooling, the mold is removed and the glass globe with the gasket cast against it, so to speak, is assembled with a production globe ring. It will be appreciated that in this variant, the production globe rings must have their metal cones accurately machined to conform to the mold used in recasting the solder gasket.

The solder joint illustrated in FIG. 3 is remarkable in that neither the glass globe nor the aluminum globe ring are wet by the solder. Yet the combination has been tested to withstand a water pressure of 450 p.s.i. without leaking. The probable explanation is that the aluminum globe ring having the higher coefficient of expansion puts the solder gasket in compression as it cools, and the solder gasket in turn compresses the glass. The thickness of the solder gasket 9 as represented in FIG. 3 has been exaggerated for purposes of illustration: a typical thickness is 0.060 inch.

While a low melting temperature metal or alloy is preferred for the gasket or joint material in making a nonflame-propagating joint, some non-metallic materials such as synthetic resins may also be used. The resins must be resistant to hydrocarbon vapors at the operating temperature of the fixture over extended periods of time. Fluorosilicone and fluorocarbon resins can meet these requirements. Fluorosilicone (sold by General Electric Company under the trademark RTV) must be carefully applied to the faying surfaces in order to fill the joint and avoid creating any bubbles. Fluorocarbon (sold by E. I. Du Pont de Nemours Company under the trademark Teflon) may be assembled with the globe and globe ring as a precast gasket and then inductively heated while subject to pressure in order to recast it to fit.

The particular tempered glass globe and globe ring combination which have been described in detail are intended by way of example of the invention. Numerous modifications may be made without departing from the true spirit and scope of the invention and I intend by the appended claims to cover all such equivalent variations.

What we claim as new and desire to secure by Letters Patent of the United States is:

1. An assembly of a glass globe with a globe ring for a hazardous location luminaire comprising:

a glass globe having a globe portion and a flaring rim portion, said rim portion being substantially circular in cross-section, a globe ring for supporting said globe and fastening it to a luminaire housing, said globe ring comprising a disc-like metal body adapted for attachment to a luminaire housing, said body having a central conical aperture of predetermined slant length for accommodating said flaring rim portion, and a gasket of moldable material filling the gap between the faying surfaces of said flaring rim portion and of said conical aperture, said gasket being cast at least against the flaring rim surface of said globe whereby to achieve a nonflame-propagating seal between said globe and said globe ring, said material being one able to withstand temperature cycling and hydrocarbon fumes at the operating temperature of the globe over extended periods of time.

2. An assembly as in claim 1 wherein the moldable material is a low melting temperature metal or alloy.

3. An assembly as in claim 1 wherein the moldable material is a non-metallic material.

4. An assembly as in claim 3 wherein the moldable material is a fluorosilicone resin.

5. An assembly as in claim 3 wherein the moldable material is a fluorocarbon resin.

6. An assembly as in claim 1 wherein the glass globe is tempered.

7. An assembly of a glass globe with a globe ring as in claim 1 wherein said gasket is cast between the faying surfaces of both said flaring rim portion and said conical aperture.

8. An assembly of a glass globe with a globe ring as in claim 2 wherein said globe ring has an undercut groove in the wall of the conical aperture near its top, said groove being filled with solidified low melting point metal overlapping the top of said flaring rim and serving as a keyway locking the globe to the globe ring.

9. The combination of an assembly of a glass globe with a globe ring as in claim 1 and a luminaire housing, said globe ring having a threaded periphery engaging mating threads on the inside of said housing at its lower edge.

* * * * *